United States Patent [19]

Manfredi

[11] 4,384,645

[45] May 24, 1983

[54] DENTAL HYGIENE KIT

[76] Inventor: John A. Manfredi, 309 Nelson St., Brantford, Ontario, Canada

[21] Appl. No.: 248,077

[22] Filed: Mar. 27, 1981

Related U.S. Application Data

[63] Continuation of Ser. No. 82,176, Oct. 5, 1979, abandoned, which is a continuation-in-part of Ser. No. 781,014, Mar. 24, 1977, abandoned.

[51] Int. Cl.[3] ..... B65D 69/00; B65D 71/00

[52] U.S. Cl. ..... 206/229; 206/235; 206/277

[58] Field of Search ..... 206/235, 277, 581, 229, 206/15.2, 15.3; 220/408, 410; 132/99 A, 84 B

[56] References Cited

U.S. PATENT DOCUMENTS

| | | | |
|---|---|---|---|
| 793,259 | 6/1905 | Wilson | 206/229 |
| 1,339,265 | 5/1920 | Levitan | 132/84 B |
| 1,505,363 | 8/1924 | Mather | 132/84 B |
| 1,716,617 | 6/1929 | Brockelsby | 132/84 B |
| 2,233,522 | 3/1941 | Fickle | 132/84 B |
| 2,399,660 | 5/1946 | Boulicault | 206/229 |
| 2,601,244 | 6/1952 | Boulicault | 132/84 B |

FOREIGN PATENT DOCUMENTS

| | | | |
|---|---|---|---|
| 564499 | 9/1944 | United Kingdom | 206/235 |

*Primary Examiner*—Joseph Man-Fu Moy

[57] ABSTRACT

A dental hygiene kit having a main body, a toothbrush detachably fastened to one end of the main body, a sleeve or cover for enclosing the toothbrush, and fitting around a portion of the main body, the main body constituting a handle portion having a cavity or recess therein, and a toothpaste container shaped to fit snugly within the cavity, the toothpaste container being formed of a flexible material and having a nozzle and cap at one end, through which toothpaste may be squeezed onto the brush, and at the other end, having an open end, and having a cylindrical member located at the open end, forming an outer wall around the open end of the container, which is expanded or bulged relative to the rest of the container making a push-tight fit within the cavity so that it will remain securely in place until removed for use.

3 Claims, 6 Drawing Figures

DENTAL HYGIENE KIT

This application is a continuation of U.S. application Ser. No. 082,176 filed Oct. 5, 1979 which in turn is a continuation-in-part of Ser. No. 781,014 filed Mar. 24, 1977, all abandoned.

The invention relates to a dental hygiene kit of the type which is personally portable and may be carried in a handbag or pocket for use away from a persons residence.

BACKGROUND OF THE INVENTION

A wide variety of different proposals have been made for portable toothbrush kits, but few if any have been successful. Many of the designs have been so complex as to be unworkable or uneconomical to manufacture. Many of them incorporate various intricate passageways through which toothpaste or powder is intended to flow from some form of container in a handle to the brush portion of the device. These systems are useless in that the toothpaste will dry or clog the passageway after a single use. Other systems provide a cavity for receiving a separate toothpaste container. However, it is then necessary to supply toothpaste packaged in an appropriate container to fit the cavity, and this causes extra expense, and specialized packaging machinery.

BRIEF SUMMARY OF THE INVENTION

The present invention seeks to overcome the foregoing disadvantages by the provision of a portable dental hygiene kit of the type having a toothbrush and a removable toothpaste container within a handle portion of the brush, said dental hygiene kit comprising a main body portion having brush-attaching means thereon and a toothbrush removably attached thereto, said main body portion constituting a handle portion and a recess within said handle means, said recess having a blind end and an open end and a predetermined internal diameter, a toothpaste container having flexible side walls, a nozzle and a cap at one end, being freely removably disposable within said recess, being of a generally regular cylindrical shape from its said one end to a point short of its other end, and having an external diameter less than said internal diameter of said recess, an opening at said other end, a radially outwardly enlarged terminal portion at said other end of said container, such enlarged portion making a tight push fit within said open end of said handle means for retaining said toothpaste container therein, a closure for said other end and being removable therefrom to permit refilling of said toothpaste container, an external annular flange to limit the extent of insertion of said toothpaste container into said handle means, and removable cover means for covering said toothbrush when not in use.

More particularly, it is an objective of the invention to provide a dental hygiene kit having the foregoing advantages in which a collar defines a threaded opening of sufficient diameter to receive the nozzle of a conventional toothpaste tube to facilitate refilling with toothpaste when necessary.

The invention further comprises airways in the handle cavity permitting the escape of air from the cavity when the container is inserted.

The invention further comprises an offset boss on the main body, and an opening in the boss extending through into the handle cavity, and a key way in the opening. The brush has a stub member fitting in the opening, and a ridge fitting in the key way.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF A SPECIFIC EMBODIMENT

Figure 1:
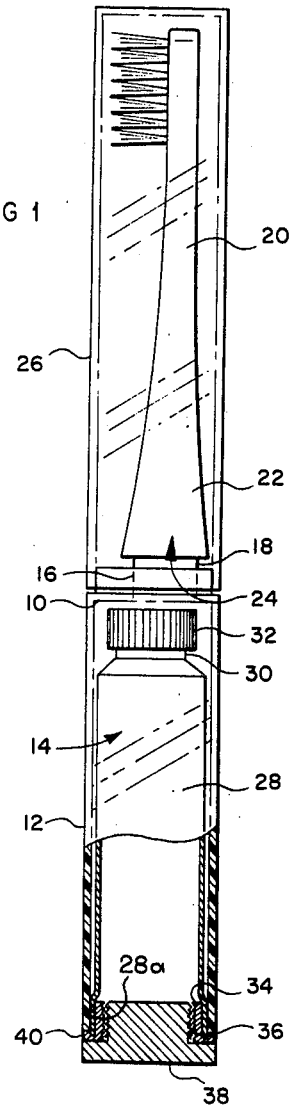
FIG. 1 is a side elevational view showing the dental hygiene kit according to the invention, with portions thereof transparent so as to reveal the interior.

Referring now to FIG. 1, the dental hygiene kit according to the invention will be seen to comprise a main body portion 10 having a cylindrical handle 12 defining an interior cavity 14.

Figure 3:
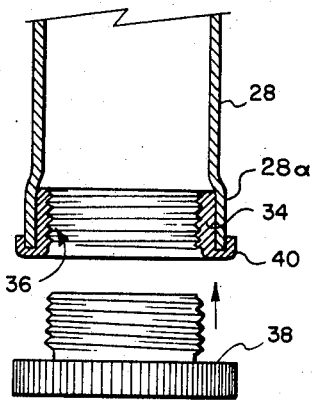
FIG. 3 shows an enlarged section of the lower end of the toothpaste container.

At the upper end of the body 10, a neck portion 16 extends upwardly and is provided with an offset boss 18 (FIG. 3). A toothbrush 20 has an enlarged stub 22 of generally conical shape defining within it a socket 24 adapted to receive the boss 18 within it. The boss 18 may be locked in place by any suitable snap-fitting formation, wedging it in place so that it may be removed with the application of force. In this way, the toothbrush, when worn out may be discarded and thrown away. The toothbrushes 20 are of a standardized design such as are typically used in electrical toothbrushes and are thus readily available in drug stores for replacement purposes.

A cylindrical protective sleeve 26 fits over the toothbrush 20 and makes a snug fit around the main body 10 so as to protect the toothbrush 20 when not in use.

Within the cavity 14 in the handle 12 there is located a flexible plastic toothpaste container 28. The container 28 has at its upper end a nozzle 30, which is exteriorly threaded, and provided with an interior threaded closure cap 32 of conventional design. Toothpaste within the container 28 can thus be removed by removing the cap 32 and squeezing the tube so as to eject toothpaste through nozzle 30.

At the lower end of the container 28 an oversize cylindrical sleeve member 34 is inserted, and fastened in any suitable way for example by solvent, ultra-sonic welding or the like. The collar 34 is of sufficient size to slightly distend the flexible material of the container 28 at 28*a* so that in the region of the member 34, the container 28 is securely wedged into the cavity 14. Note that the remainder of container 28, where it is not distended is undersize with respect to cavity 14. In this way, air may readily flow around container 28, preventing any suction or compression effect. The member 34 defines an interior threaded opening 36 sufficiently large to receive the nozzle of a conventional toothpaste tube (not shown). In this way, the container 28 may easily be refilled from a conventional toothpaste tube in the home. In order to close off the lower end of the container 28, a closure plug 38 is provided having exterior threads enabling it to be threadedly fastened into the interior threads of the member 34. The plug 38 is preferably provided with a knurled rim by means of which it may be rotated and extracted. If desired, some suitable form of compressible seal such as a rubber ring or the like may be provided to provide a good fluid tight seal to avoid leakage of toothpaste at this point.

While a two piece container is shown, i.e., the cylindrical sleeve member 34 is shown separate from the container, it is apparent that the two parts could be formed integrally in one piece by well known injection forming techniques or joined in any other way. The member 34 will of course be such as to define an enlarged diameter end on the container.

In order to prevent over insertion of the toothpaste container 28 into the cavity 14, some form of stop is preferably provided. In this case such a stop will comprise the flange or rim 40 extending outwardly from the member 34 and engaging the lower end of the handle 12. In this way it is impossible to force the toothpaste container 28 too far into the cavity 14 which might otherwise cause it to become damaged or leak.

The operation of the invention will be self-evident. In use, the sleeve 26 and toothpaste container are removed from the main body. A small quantity of toothpaste is then ejected through the nozzle, onto the toothbrush after which the cap is then replaced and the container is then reinserted into the cavity 14. When the toothpaste container 28 requires to be refilled, all that is necessary is simply to remove the plug, insert the nozzle of a conventional toothpaste tube and refill the container 28 after which the plug is reinserted and is screwed home tightly.

In this way, the invention uses a replaceable toothbrush component which is readily replaced when required, and by the use of a refillable toothpaste container, open at both ends, the user can use his favourite brand of toothpaste in the container.

The offset boss 18 achieves a significant reduction in overall dimensions of the kit, by locating the toothbrush to one side of the central axis of the main body.

Figure 2:
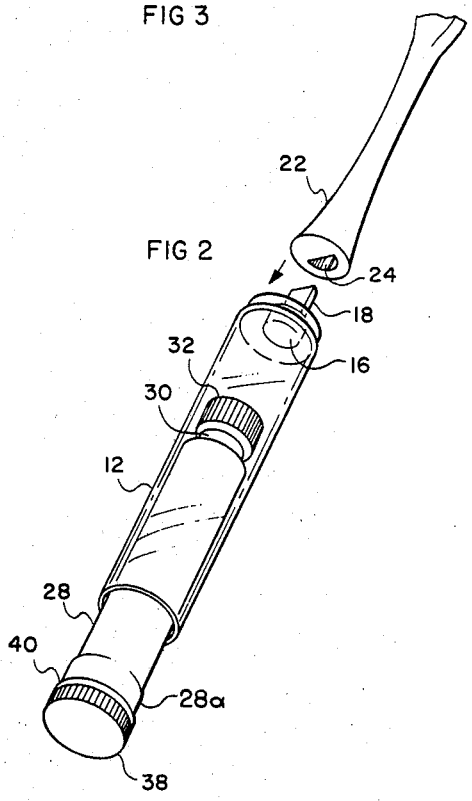
FIG. 2 is a perspective view showing the handle and toothpaste container partially exploded.
Figure 4:
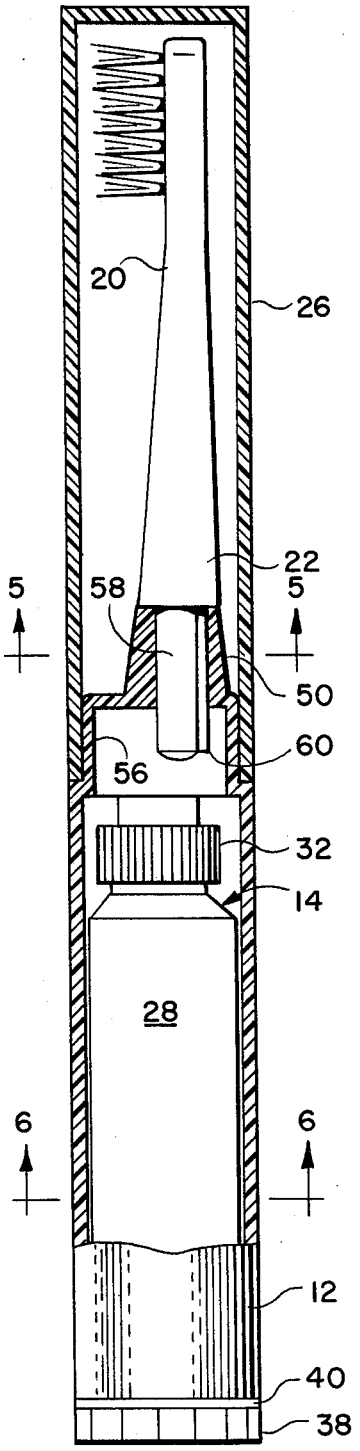
FIG. 4 is a longitudinal section of an alternate form of the invention.
Figure 6:
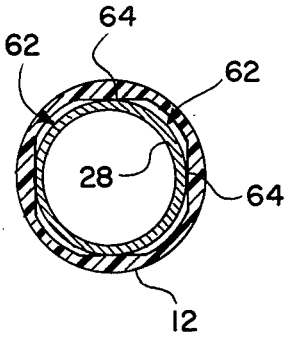
FIG. 6 is a section along 6—6 of FIG. 4.
Figure 5:
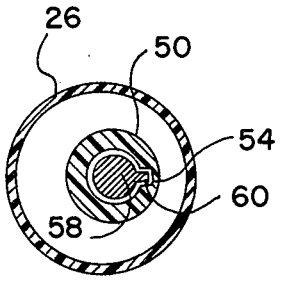
FIG. 5 is a section along 5—5 of FIG. 4.

In FIGS. 4, 5 and 6, a further embodiment of the invention is shown, with the same features being shown by the references numbers as are used in FIGS. 1 to 3.

In this case, however, a modified offset boss 50 is used, having a generally cylindrical through opening 52 with a key way 54 formed along one side thereof.

At the upper end of the main body, a reduced neck portion 56 is provided, being essentially an endwise extension of the handle 12, the neck portion 56 being hollow so as to receive the cap 32 of the toothpaste tube 28 therein.

Brush 20 is provided with a generally cylindrical shaped stub portion 58, extending from the end thereof remote from the bristles, and having a ridge member 60 thereon adapted to fit within the key way 54.

In this way, the brush 20 is joined more securely to the handle 12, while still being removable therefrom. Any tendency for the brush 20 to twist in use is resisted by means of the ridge 60 in key way 54.

The interior of the handle 12 is modified so as to provide a plurality of airways 62, spaced apart by flattened ridge portions 64. It will of course be appreciated that strictly speaking only one such airway 62 is necessary, although four in this case are provided for the sake of uniformity.

The exterior of the toothpaste tube 28, where it is distended or enlarged in the region of member 34, is adapted to make a good tight push fit in the ridge portions 64, so as to hold the toothpaste tube 28 in position in the handle 12.

However, the toothpaste tube 28 is of such dimensions that it will not obstruct the airways 62. In this way, insertion and removal of the tube 28 into the handle cavity is greatly facilitated, and any tendency for the toothpaste tube 28 to eject itself, due to contained air pressure, is prevented.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A portable dental hygiene kit of the type having a toothbrush having handle means and a removable toothpaste container within said handle means said dental hygiene kit comprising;

a main body portion having brush-attaching means thereon and a toothbrush removably attached to said body portion, said main body portion constituting said handle means for the toothbrush and including a recess having a blind end, and an open end with a predetermined internal diameter;

a toothpaste container having flexible side walls and two ends;

two separate spaced apart openings in said toothpaste container comprising a discharge nozzle opening of predetermined size at one said end of said container and a filling opening of a size larger than such discharge opening, at the other said end of said container, whereby toothpaste may be inserted into such container through said filling opening, and later dispensed from said container through said discharge nozzle opening said container being freely removably disposable within said recess, being of a generally regular cylindrical shape from its said one end to a point short of its other end, and having an external diameter less than said internal diameter of said recess;

an enlarged terminal portion at said other end of said toothpaste container around said filling opening said enlarged terminal portion having an external diameter greater than the external diameter of the remainder of said side walls of said container, and extending radially outwardly such enlarged terminal portion making a tight push fit within said open end of said handle means for retaining said toothpaste container therein;

two separate closures for respective said openings of said toothpaste container and being removable therefrom to permit dispensing and refilling of toothpaste from and into said toothpaste container through respective said openings;

an external annular flange on at least one of said terminal portion and said respective closure to limit the extent of insertion of said toothpaste container into said handle portion, and, removable cover means for covering said toothbrush when not in use.

2. A dental hygiene kit as claimed in claim 1 wherein said terminal portion incorporates an annular flange extending outwardly from said toothpaste container, whereby to limit insertion of said toothpaste container into said handle portion.

3. A dental hygiene kit as claimed in claim 1 including a sleeve-like member inserted into said toothpaste container at said other end having an oversize dimension relative thereto thereby distending same.

* * * * *